US010557441B2

(12) United States Patent
Kato et al.

(10) Patent No.: US 10,557,441 B2
(45) Date of Patent: Feb. 11, 2020

(54) EVAPORATED FUEL PROCESSING DEVICE

(71) Applicant: AISAN KOGYO KABUSHIKI KAISHA, Obu-shi (JP)

(72) Inventors: Nobuhiro Kato, Tokai (JP); Daisaku Asanuma, Gamagori (JP)

(73) Assignee: AISAN KOGYO KABUSHIKI KAISHA, Obu-Shi (JP)

( * ) Notice: Subject to any disclaimer, the term of this patent is extended or adjusted under 35 U.S.C. 154(b) by 0 days.

(21) Appl. No.: 16/089,555

(22) PCT Filed: Mar. 3, 2017

(86) PCT No.: PCT/JP2017/008608
§ 371 (c)(1),
(2) Date: Sep. 28, 2018

(87) PCT Pub. No.: WO2017/169520
PCT Pub. Date: Oct. 5, 2017

(65) Prior Publication Data

US 2019/0113007 A1 Apr. 18, 2019

(30) Foreign Application Priority Data

Mar. 30, 2016 (JP) ..... 2016-069337

(51) Int. Cl.
*F02M 25/08* (2006.01)
*F02D 41/00* (2006.01)

(52) U.S. Cl.
CPC ..... *F02M 25/0836* (2013.01); *F02D 41/0045* (2013.01); *F02M 25/0809* (2013.01)

(58) Field of Classification Search
CPC ..... F02M 25/0836; F02M 25/0809; F02M 25/08; F02M 25/0818; F02D 41/0045; F02D 41/004
See application file for complete search history.

(56) References Cited

U.S. PATENT DOCUMENTS 7,320,315 B2 1/2008 Amano et al.
7,409,947 B2 8/2008 Koyama
(Continued)

FOREIGN PATENT DOCUMENTS

JP H06101534 A 4/1994
JP H07174049 A 7/1995
(Continued)

OTHER PUBLICATIONS

International Search Reported dated Apr. 25, 2017 in International Patent Application No. PCT/JP2017/008608 with English translation (5 pgs.).
(Continued)

*Primary Examiner* — George C Jin
(74) *Attorney, Agent, or Firm* — Shumaker, Loop & Kendrick, LLP

(57) ABSTRACT

An evaporated fuel processing device may include: a canister configured to adsorb fuel evaporated in a fuel tank; a purge passage through which a purge gas sent from the canister to the intake passage passes; a control valve provided on the purge passage and having a variable aperture; and a differential pressure sensor configured to detect a pressure difference between an upstream side and a downstream side of the control valve.

7 Claims, 17 Drawing Sheets

(56) References Cited

U.S. PATENT DOCUMENTS

| | | | | |
|---|---|---|---|---|
| 2008/0092858 | A1* | 4/2008 | Satoh | F02M 25/0809 123/520 |
| 2011/0308302 | A1* | 12/2011 | Makino | F02M 25/0836 73/40.7 |
| 2016/0108864 | A1* | 4/2016 | Tochihara | F02M 25/089 123/520 |
| 2016/0326990 | A1* | 11/2016 | Pursifull | F02M 25/089 |

FOREIGN PATENT DOCUMENTS

| | | | |
|---|---|---|---|
| JP | H08128363 | A | 5/1996 |
| JP | 2003042008 | A | 2/2003 |
| JP | 2004116303 | A | 4/2004 |
| JP | 2007170221 | A | 7/2007 |
| JP | 2007198267 | A | 8/2007 |
| JP | 2007198358 | A | 8/2007 |

OTHER PUBLICATIONS

English translation of International Preliminary Examination Report (IPER) dated Mar. 27, 2018 of PCT International App. No. PCT/JP2017/008608 (5 pages).

* cited by examiner

EVAPORATED FUEL PROCESSING DEVICE

TECHNICAL FIELD

The description herein discloses a technique related to an evaporated fuel processing device. Especially, an evaporated fuel processing device configured to process evaporated fuel generated in a fuel tank by purging the same to an intake passage of an engine is disclosed.

BACKGROUND ART

JP H6-101534 (hereinbelow termed Patent Document 1) describes an evaporated fuel processing device. In this Patent Document 1, a sensor configured to detect a fluid density of air introduced to a canister and a sensor configured to detect a fluid density of a purge gas sent to an engine from the canister are provided, and a concentration of the purge gas is calculated based on a ratio or a difference of the fluid densities thereof. Further, a flow rate of the purge gas to be introduced to an intake passage is determined based on the calculated gas concentration, and the flow rate of the purge gas sent to the engine is adjusted by using a purge valve that is controlled on a duty basis.

SUMMARY OF INVENTION

Technical Problem

To stabilize an air-fuel ratio (A/F) of an engine, a purge gas concentration needs to be detected accurately and a flow rate of the gas to be introduced to an intake passage needs to be controlled accurately. Patent Document 1 uses various components to detect a gas concentration and adjust a gas flow rate. However, as a number of components increases in an evaporated fuel processing device, a new problem occurs. For example, when a sensor for detecting a fluid density is used, a passage resistance in a purge passage increases, and this may impose restriction on an introduction quantity of a purge gas. Further, when a purge valve that is controlled on a duty-basis is used, means for reducing vibration accompanying on and off (opening and closing) of the purge valve needs to be provided, and the number of components may further be increased. The description herein reconsiders a structure of an evaporated fuel processing device, and provides a technique for implementing an evaporated fuel processing device capable of adjusting a flow rate of a purge gas sent to an engine by a simple configuration.

Solution to Problem

An evaporated fuel processing device disclosed herein may comprise a canister, a purge passage, a control valve, and a differential pressure sensor. The canister may be configured to adsorb fuel evaporated in a fuel tank. The purge passage may be connected between the canister and an intake passage of an engine. A purge gas sent from the canister to the intake passage may pass through the purge passage. The control valve may be provided on the purge passage. An aperture of the control valve may be variable, and the control valve may be configured to control an introduction quantity of the purge gas to the intake passage by changing the aperture. The differential pressure sensor may be configured to detect a pressure difference between an upstream side and a downstream side of the control valve.

In the above evaporated fuel processing device, a gas concentration of the purge gas passing through the purge passage can be detected by measuring the pressure difference between the upstream side and the downstream side of the control valve by the differential pressure sensor. That is, the control valve and the differential pressure sensor constitute a concentration sensor for measuring the purge gas concentration. Further, by adjusting the aperture of the control valve, the introduction quantity of the purge gas to the intake passage can be adjusted. The control valve of the above evaporated fuel processing device serves both a function of a purge valve and a function of a concentration sensor in a conventional evaporated fuel processing device. The above evaporated fuel processing device can directly detect the gas concentration of the purge gas passing through the purge passage and can adjust the introduction quantity of the purge gas to the intake passage while maintaining its configuration simple. Further, the above evaporated fuel processing device does not need to use a purge valve that adjusts the introduction quantity of the purge gas by repeating on and off, so a countermeasure against vibration accompanying this on and off operations is also unnecessary.

DETAILED DESCRIPTION OF EMBODIMENTS

Figure 1:
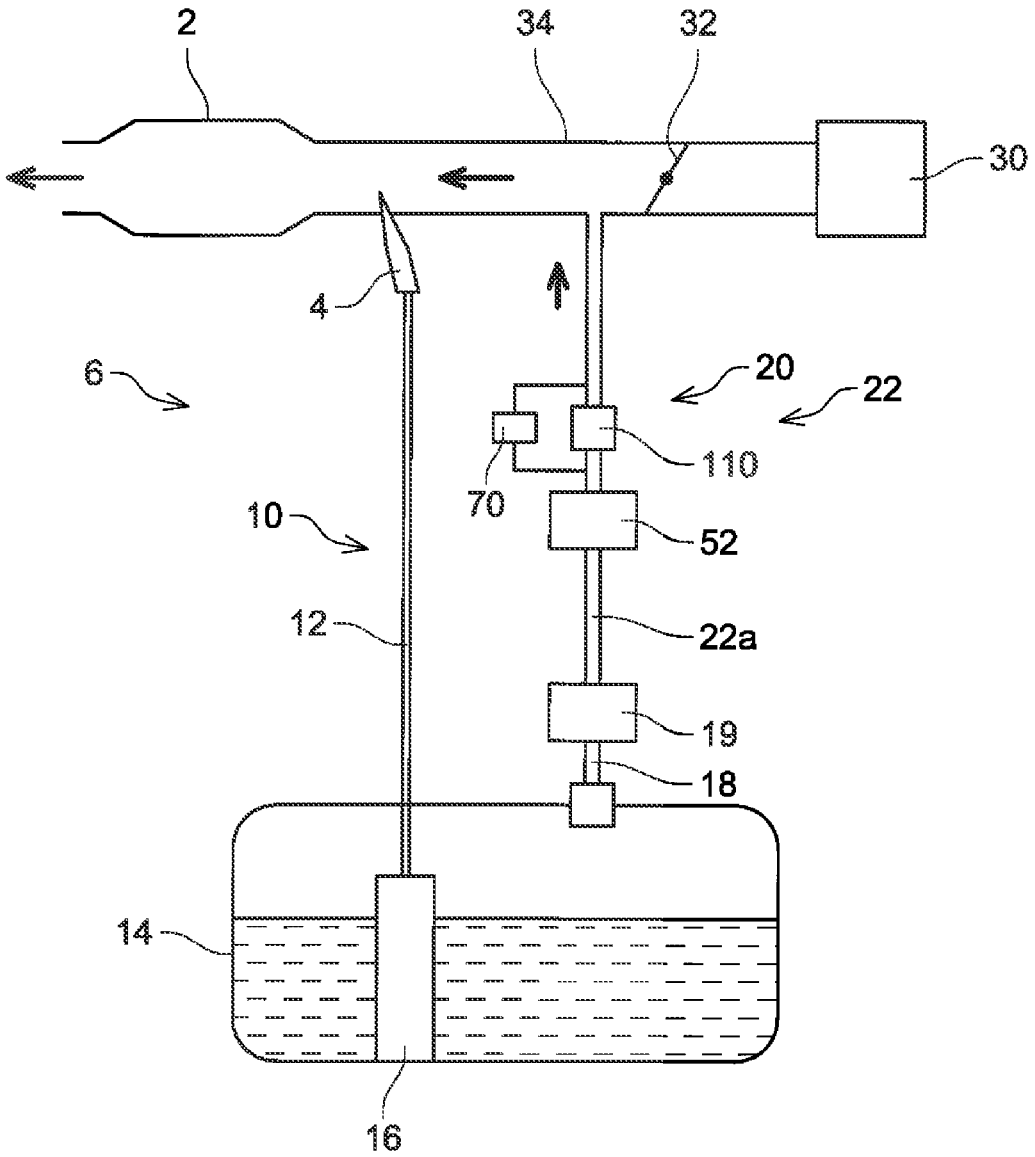
FIG. 1 shows a fuel supply system of a vehicle using an evaporated fuel processing device of a first embodiment.

Primary features of embodiments described below will be listed. It should be noted that the respective technical elements described below are independent of one another, and are useful solely or in combinations.

(Feature 1) In an evaporated fuel processing device disclosed herein, a control valve of which aperture is variable may be provided on a purge passage, and a differential pressure sensor configured to detect a pressure difference between an upstream side and a downstream side of the control valve may be provided. The evaporated fuel processing device may comprise a pump that is configured to discharge a purge gas from a canister to an intake passage. The pump may be provided on the purge passage. The pump may be provided on the purge passage between the control valve and the canister. By the pump being provided, the purge gas can be introduced to the intake passage regardless of a pressure state (positive pressure, negative pressure, or normal pressure) in the intake passage. For example, in a vehicle that includes a supercharger, the purge gas can be introduced to the intake passage even when the intake passage is at the positive pressure.

(Feature 2) The evaporated fuel processing device may comprise a solenoid valve configured to switch between a communication state and a cutoff state, wherein the communication state is a state in which the canister and the intake passage communicate with each other via the purge passage, and the cutoff state is a state in which communication between the canister and the intake passage is cut off on the purge passage. Further, a branch passage may be provided in addition to the solenoid valve. The branch passage may include one end connected to the purge passage between the control valve and the solenoid valve, and another end connected to the purge passage on a canister side relative to the pump. That is, the branch passage may be connected in parallel to the control valve. In this case, when the solenoid valve switches to the cutoff state with the pump being driven, the purge gas circulates through the purge passage and the branch passage, the pressure difference between the upstream and downstream sides of the control valve is detected, and the purge gas concentration can thereby be calculated.

(Feature 3) The evaporated fuel processing device may comprise a controller configured to control operations of the control valve, the solenoid valve, and the pump. In this case, the controller may switch the solenoid valve to the cutoff state in a case where a change in a concentration of the purge gas exceeds a predetermined value when the purge gas is introduced to the intake passage. Due to this, an A/F can be suppressed from being greatly deviated. Further, the controller may detect the concentration of the purge gas passing through the control valve after having switched the solenoid valve to the cutoff state. Further, the controller may readjust the aperture of the control valve, an output of the pump and the like based on the detected purge gas concentration.

EMBODIMENTS

First Embodiment

A fuel supply system 6 provided with an evaporated fuel processing device 20 will be described with reference to FIG. 1. The fuel supply system 6 is provided with a main supply passage 10 for supplying fuel stored in a fuel tank 14 to an engine 2 and a purge supply passage 22 for supplying evaporated fuel generated in the fuel tank 14 to the engine 2.

The main supply passage 10 is provided with a fuel pump unit 16, a supply pipe 12, and an injector 4. The fuel pump unit 16 is provided with a fuel pump, a pressure regulator, a control circuit, and the like. The fuel pump unit 16 controls the fuel pump according to a signal provided from an ECU (not shown). The fuel pump boosts the fuel in the fuel tank 14 and discharges the same. The fuel discharged from the fuel pump is pressure-regulated by the pressure regulator and is supplied from the fuel pump unit 16 to the supply pipe 12. The supply pipe 12 is connected to the fuel pump unit 16 and the injector 4. The fuel supplied to the supply pipe 12 passes through the supply pipe 12 and reaches the injector 4. The injector 4 includes a valve (not shown) of which aperture is controlled by the ECU. When the valve of the injector 4 is opened, the fuel in the supply pipe 12 is supplied to an intake pipe 34 connected to the engine 2.

The intake pipe 34 is connected to an air cleaner 30. The air cleaner 30 includes a filter for removing foreign matters in air flowing into the intake pipe 34. The intake pipe 34 is provided with a throttle valve 32. When the throttle valve 32 opens, suction is performed from the air cleaner 30 toward the engine 2. The throttle valve 32 adjusts an aperture of the intake pipe 34 and thereby adjusts a quantity of air flowing into the engine 2. The throttle valve 32 is provided on an upstream side (air cleaner 30 side) than the injector 4.

The purge supply passage 22 includes the evaporated fuel processing device 20, and a communication pipe 18 that communicates the fuel tank 14 and the evaporated fuel processing device 20. The evaporated fuel processing device 20 includes a canister 19, a purge passage 22*a*, a control valve 110, and a differential pressure sensor 70. Further, the evaporated fuel processing device 20 also includes a pump 52. The communication pipe 18 connects the fuel tank 14 and the canister 19. The canister 19, the control valve 110, and the pump 52 are provided on the purge passage 22*a*. The purge passage 22*a* connects the canister 19 and the intake pipe 34. The evaporated fuel (purge gas) adsorbed in the canister 19 passes through the purge passage 22*a* and is introduced to the intake pipe 34. The pump 52 is arranged between the canister 19 and the control valve 110, and pumps the purge gas to the intake pipe 34. The control valve 110 is a valve capable of adjusting a passage area for the purge gas by changing its aperture. By changing the aperture of the control valve 110, a flow rate of the purge gas introduced to the intake pipe 34 during a purge can be adjusted. As an example of the control valve, a stepping motor-type flow rate control valve may be exemplified.

Typically, inside of the intake pipe 34 is at a negative pressure during when the engine 2 is driving. Due to this, the evaporated fuel adsorbed in the canister 19 can be introduced to the intake pie 34 by a pressure difference between the intake pipe 34 and the canister 19. Due to this, the pump 52 may be omitted. By providing the pump 52 on the purge passage 22*a*, the evaporated fuel processing device 20 can supply the evaporated fuel adsorbed in the canister 19 to the intake pipe 34 even in a case where the intake pipe 34 is at a pressure that is not sufficient to draw in the purge gas (in a case of a positive pressure while supercharging or in a case of a negative pressure having a small absolute value thereof). Further, by providing the pump 52, a desired quantity of the evaporated fuel can be supplied to the intake pipe 34.

Figure 2:
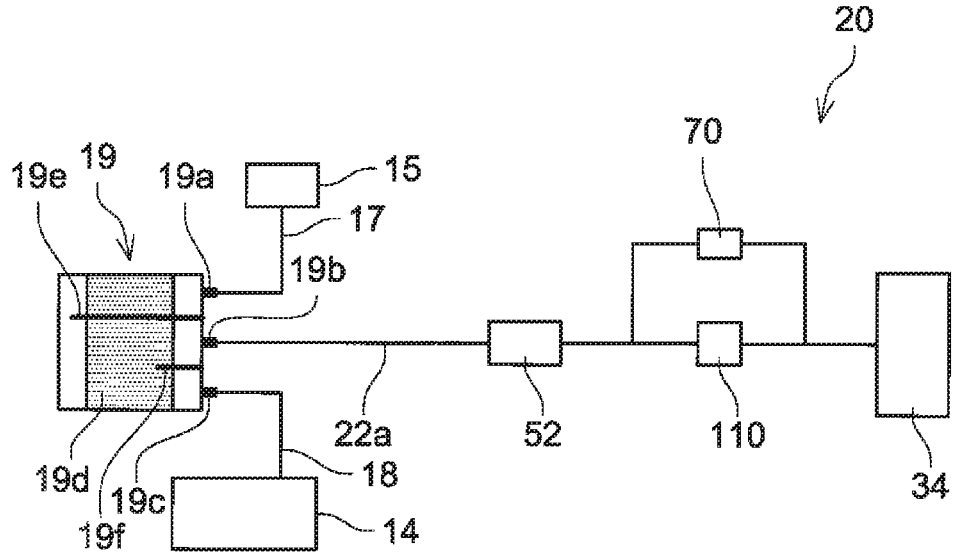
FIG. 2 shows the evaporated fuel processing device of the first embodiment.

As shown in FIG. 2, the canister 19 is provided with an air port 19*a*, a purge port 19*b*, and a tank port 19*c*. The air port 19*a* is connected to an air filter 15 via a communication pipe 17. The purge port 19*b* is connected to the purge passage 22*a*. The tank port 19*c* is connected to the fuel tank 14 via the communication pipe 18. Activated charcoal 19*d* is accommodated in the canister 19. The ports 19*a*, 19*b*, and 19*c* are provided on one of wall surfaces of the canister 19 that face the activated charcoal 19*d*. A space exists between the activated charcoal 19*d* and the inner wall of the canister 19 on which the ports 19*a*, 19*b*, and 19*c* are provided. A first partitioning plate 19*e* and a second partitioning plate 19*f* are fixed to the inner wall of the canister 19 on which the ports 19*a*, 19*b*, and 19*c* are provided. The first partitioning plate 19*e* partitions the space between the activated charcoal 19*d* and the inner wall of the canister 19 in a range between the air port 19*a* and the purge port 19*b*. The first partitioning plate 19*e* extends to a space on an opposite side to the side where the ports 19*a*, 19*b*, and 19*c* are provided. The second partitioning plate 19*f* partitions the space between the activated charcoal 19*d* and the inner wall of the canister 19 in a range between the purge port 19*b* and the tank port 19*c*.

The activated charcoal 19*d* adsorbs the evaporated fuel from the gas that flows into the canister 19 from the fuel tank 14 through the communication pipe 18 and the tank port 19*c*. The gas from which the evaporated fuel has been adsorbed is discharged to open air by passing through the air port 19*a*, the communication pipe 17, and the air filter 15. The canister 19 can prevent the evaporated fuel in the fuel tank 14 from being discharged to open air. The evaporated fuel adsorbed by the activated charcoal 19*d* is supplied to the purge passage 22*a* from the purge port 19*b*. The first partitioning plate 19*e* partitions between the space where the air port 19*a* is connected and the space where the purge port 19*b* is connected. The first partitioning plate 19*e* prevents the gas containing the evaporated fuel from being discharged to open air. The second partitioning plate 19*f* partitions between the space where the purge port 19*b* is connected and the space where the tank port 19*c* is connected. The second partitioning plate 19*f* prevents the gas flowing into the canister 19 from the tank port 19*c* from flowing directly to the purge passage 22*a*.

As aforementioned, the control valve 110 adjusts the flow rate of the purge gas introduced to the intake pipe 34 during a purge by changing its aperture. Due to this, a pressure difference is generated between upstream and downstream sides of the control valve 110. The differential pressure sensor 70 is connected to the upstream and downstream sides of the control valve 110 and can detect the pressure difference between the upstream and downstream sides of the control valve 110. By detecting the pressure difference between the upstream and downstream sides of the control valve 110, a density of the purge gas (purge gas concentration) can be calculated using a Bernoulli equation. The control valve 110 constitutes a part of concentration sensor for detecting the gas concentration of the purge gas passing through the purge passage 22*a*.

Second Embodiment

Figure 3:
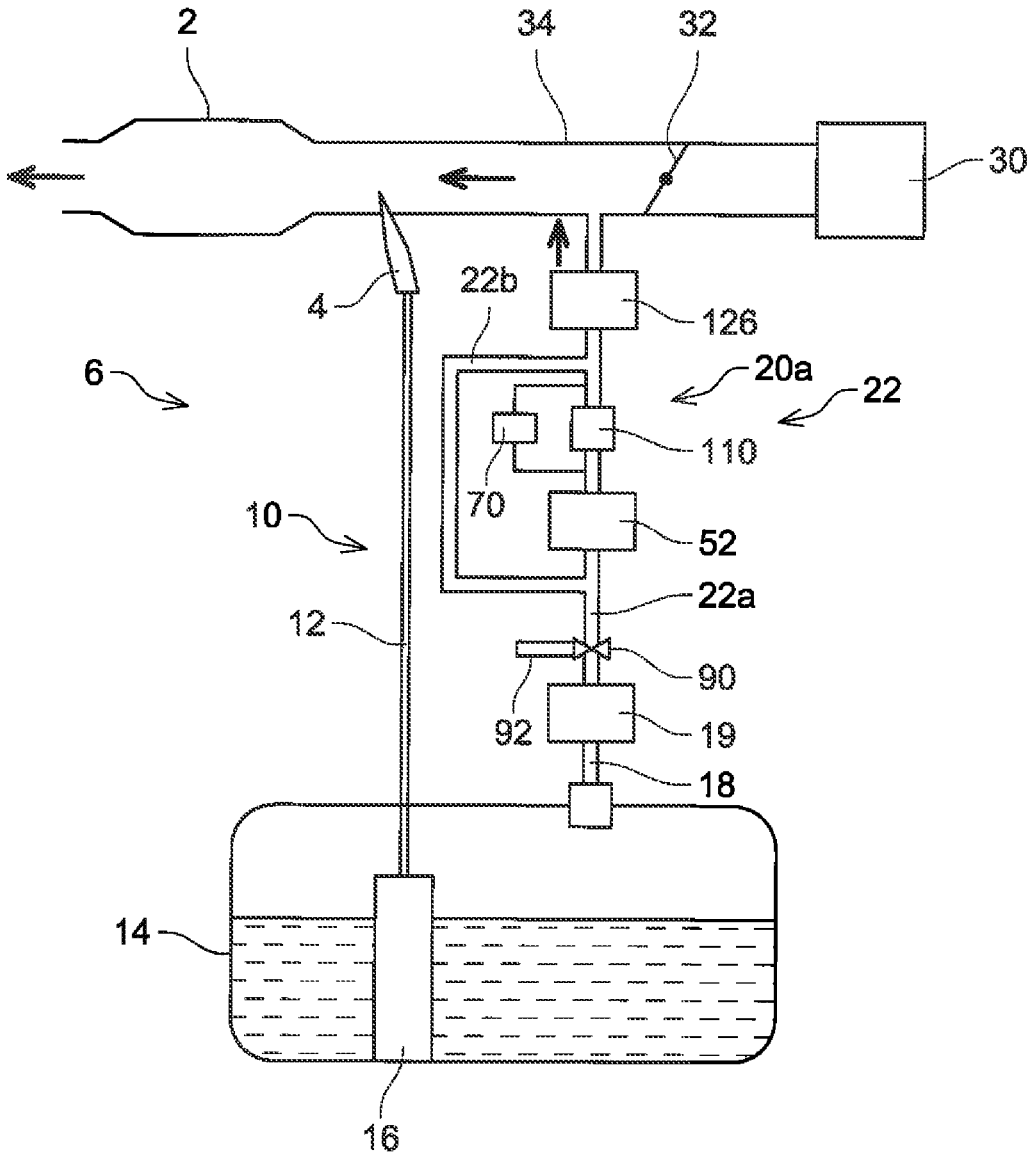
FIG. 3 shows a fuel supply system of a vehicle using an evaporated fuel processing device of a second embodiment.
Figure 4:
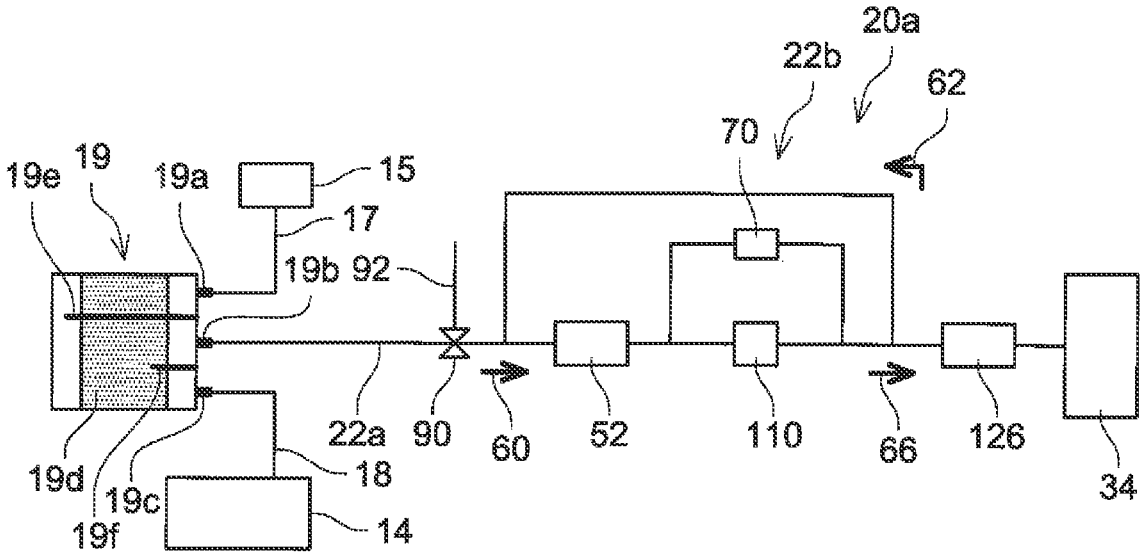
FIG. 4 shows the evaporated fuel processing device of the second embodiment.

An evaporated fuel processing device 20*a* will be described with reference to FIGS. 3 and 4. The evaporated fuel processing device 20*a* is a variant of the evaporated fuel processing device 20. Specifically, the evaporated fuel processing device 20*a* differs from the evaporated fuel processing device 20 in that a solenoid valve 126 and a branch passage 22*b* are connected to the purge passage 22*a*. Further, in the evaporated fuel processing device 20*a*, a switch valve 90 is provided on the purge passage 22*a*. For the evaporated fuel processing device 20*a*, its components that are the same as those of the evaporated fuel processing device 20 are given the same reference numbers, and description thereof may be omitted.

The evaporated fuel processing device 20*a* includes the canister 19, the purge passage 22*a*, the pump 52, the control valve 110, the solenoid valve 126, the differential pressure sensor 70, the branch passage 22*b*, the switch valve 90, and an air introducing pipe 92. The switch valve 90, the pump 52, the control valve 110, and the solenoid valve 126 are provided on the purge passage 22*a*. The solenoid valve 126 is provided on the purge passage 22*a* on a downstream side (on an intake pipe 34 side) relative to the control valve 110. The branch passage 22*b* is connected in parallel to the control valve 110. Specifically, one end of the branch passage 22*b* is connected to the purge passage 22*a* between the control valve 110 and the solenoid valve 126. Another end of the branch passage 22*b* is connected to the purge passage 22*a* on a canister 19 side relative to the pump 52, and between the pump 52 and the switch valve 90. The solenoid valve 126 is a solenoid valve that switches between a communication state in which the canister 19 and the intake pipe 34 communicate with each other via the purge passage 22*a*, and a cutoff state in which communication between the canister 19 and the intake pipe 34 is cut off on the purge passage 22*a*. On/off (the communication state/the cutoff state) of the solenoid valve 126 are controlled by the ECU.

When the solenoid valve 126 is in an on-state (in the communication state), the purge gas drawn in a direction of an arrow 60 by the pump 52 is pushed toward the intake pipe 34 in a direction of an arrow 66. When the solenoid valve 126 is in an off-state (in the cutoff state), the purge gas drawn in the direction of the arrow 60 by the pump 52 flows in a direction of an arrow 62, and circulates through the purge passage 22*a* and the branch passage 22*b*. At this occasion, the purge gas concentration is detected by the concentration sensor constituted of the control valve 110 and the differential pressure sensor 70. The evaporated fuel processing device 20*a* can detect the purge gas concentration in the purge passage 22*a* even when the solenoid valve 126 is in the off-state. The evaporated fuel processing device 20*a* can detect the purge gas concentration even in a case where the purge gas is not introduced to the intake pipe 34. For example, when the purge gas concentration changes abruptly during when a purge is performed, the purge gas concentration can be detected without introducing the purge gas to the intake pipe 34 by switching the solenoid valve 126 to the off-state while driving the pump 52.

Further, as aforementioned, the switch valve 90 is provided on the purge passage 22*a*. The switch valve 90 is provided on the upstream side relative to the pump 52. The air introducing pipe 92 is connected to the switch valve 90. The switch valve 90 can switch between a state (a first state) in which the purge passage 22*a* is connected with the canister 19 and a state (a second state) in which the purge passage 22*a* is connected with the air introducing pipe 92. By switching the switch valve 90, a pressure difference between the upstream and downstream sides of the control valve 110 upon when air passes through the purge passage 22*a* can be compared with a pressure difference between the upstream and downstream sides of the control valve 110 upon when the purge gas passes through the purge passage 22*a*. By comparing these pressure differences, a characteristic of the pump 52 (a flow rate of fluid that passes through the pump at a predetermined rotary speed) can be calculated. A flow rate of fluid passing through the pump 52 changes depending on a density (concentration) of the passing fluid, despite an output (rotary speed) of the pump 52 being the same. By providing the switch valve 90 and by comparing the pressure differences in the air and in the purge gas passing through the control valve 110, the flow rate characteristic of the pump 52 can be obtained and detection accuracy for the purge gas concentration improves, by which a more accurate quantity of the purge gas can be introduced to the intake pipe 34. The switching valve 90 and the air introducing pipe 92 contribute to improving the detection accuracy for the purge gas concentration, and the concentration of the purge gas can still be detected even when the switching valve 90 and the air introducing pipe 92 are omitted.

Figure 5:
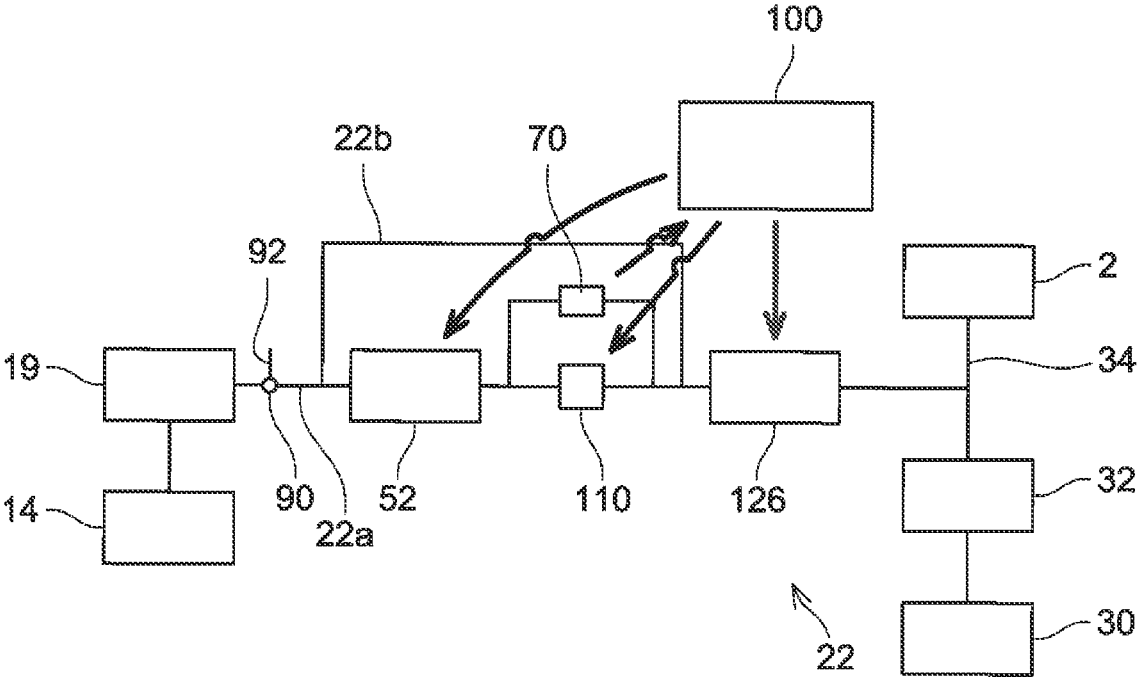
FIG. 5 shows an evaporated fuel supply system.

An operation of the purge supply passage 22 upon supplying the purge gas to the intake pipe 34 will be described with reference to FIG. 5. When the engine 2 is activated, the pump 52 starts to drive and the control valve 110 starts its opening and closing operations by the control of an ECU 100. At this occasion, the solenoid valve 126 is in the on-state (in the communication state). The ECU 100 controls the aperture of the control valve 110 and the output of the pump 52 based on the concentration of the purge gas obtained from the pressure differences detected by the differential pressure sensor 70. The ECU 100 also controls the aperture of the throttle valve 32 and on/off of the solenoid valve 126. The evaporated fuel from the fuel tank 14 is adsorbed in the canister 19. When the pump 52 starts to drive, the purge gas that was adsorbed in the canister 19 and the air having passed through the air cleaner 30 are introduced to the engine 2. Hereinbelow, some methods of detecting the concentration of the purge gas will be described.

Figure 6:
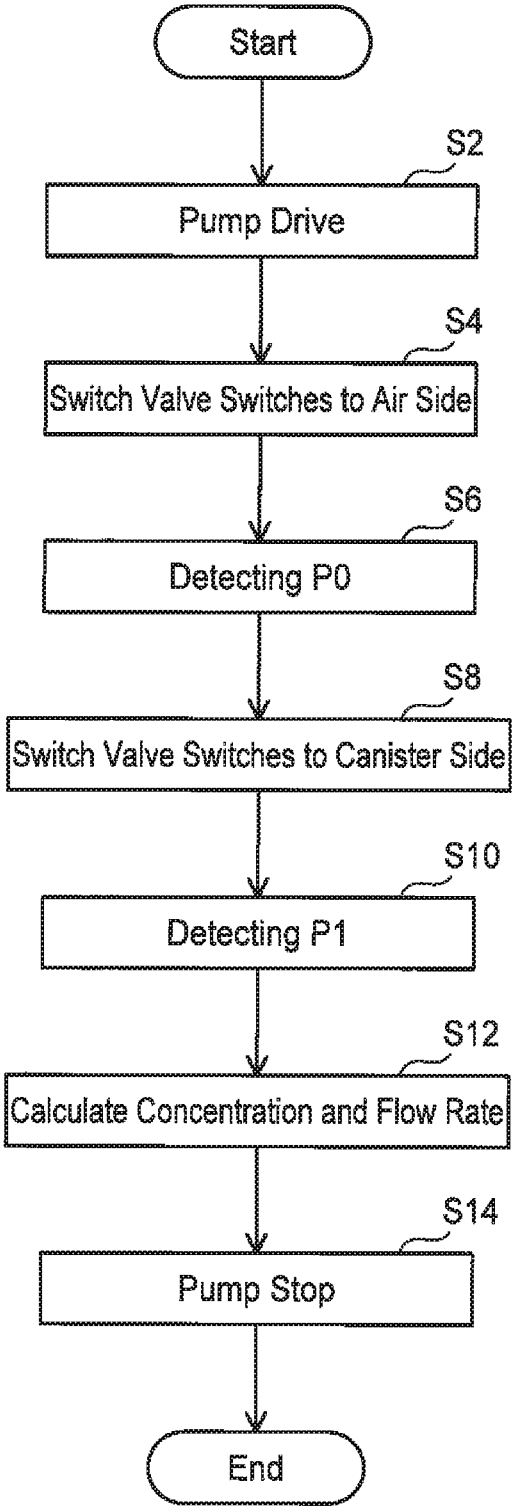
FIG. 6 shows a flowchart of a method of detecting a concentration and a flow rate of a purge gas.

FIG. 6 shows a flowchart explaining a method of detecting a purge gas concentration and a purge gas flow rate. This method is performed for calculating the flow rate characteristic of the pump 52 and detecting the flow rate of the purge gas that passes through the pump 52 when the pump 52 is under the predetermined rotary speed. This method is performed under a state in which the solenoid valve 126 is closed (the purge gas is not introduced to the intake pipe 34). This method may be performed in any evaporated fuel processing device that is provided with the switch valve 90 and the air introducing pipe 92, such as the evaporated fuel processing device 20*a*.

Firstly, the pump 52 is driven at the predetermined rotary speed by a control signal outputted from the ECU 100 (step S2). Next, the switch valve 90 switches so as to connect the purge passage 22*a* and the air introducing pipe 92 by a control signal from the ECU 100 (step S4). Due to this, the open air is introduced to the purge passage 22*a*. The air introduced to the purge passage 22*a* passes through the branch passage 22*b*. That is, by driving the pump 52, the air circulates in the purge passage 22*a* and the branch passage 22*b*. When the air passes through the control valve 110, a pressure difference is generated between the upstream and downstream sides of the control valve 110. The differential pressure sensor 70 is used to detect the pressure difference P0 between the upstream and downstream sides of the control valve 110 (step S6). After the detection of the pressure difference P0 is completed, the switching valve 90 switches so as to connect the purge passage 22*a* and the canister 19 by a control signal from the ECU 100 (step S8). Due to this, the purge gas is introduced to the purge passage 22*a*. The purge gas circulates in the purge passage 22*a* and the branch passage 22*b*. The differential pressure sensor 70 is used to detect a pressure difference P1 between the upstream and downstream sides of the control valve 110 (step S10). After the detection of the pressure difference P1, the concentration and the flow rate of the purge gas are calculated (step S12), and the driving pump 52 is stopped (step S14).

The purge gas is not contained in the open air. That is, a density of the open air is known. Due to this, by detecting the pressure differences P0, P1, the concentration of the purge gas can be detected. For example, by calculating "P1÷P0", the concentration of the purge gas can be calculated. Further, as aforementioned, the flow rate can be calculated from the Bernoulli's equation. Due to this, the flow rate of the gas (the purge gas, the air) passing through the control valve 110 can be calculated accurately from the gas concentration. Further, by comparing the flow rate of the purge gas with the flow rate of the air upon when the pump 52 is driven at the predetermined rotary speed, the flow rate characteristic of the pump 52 can be obtained, and the supply quantity of the purge gas during when a purge is being performed can more accurately be adjusted. By performing the above method (steps S2 to S14), the flow rate characteristic of the pump 52 can be obtained and the detection accuracy of the purge gas concentration can be improved. Due to this, the steps of introducing the open air to the purge passage 22*a* and measuring the pressure difference P0 between the upstream and downstream sides of the sensor (steps S4 to S8) may be omitted as needed. Even if steps S4 to S8 are omitted, the concentration of the purge gas can still be detected.

Figure 7:
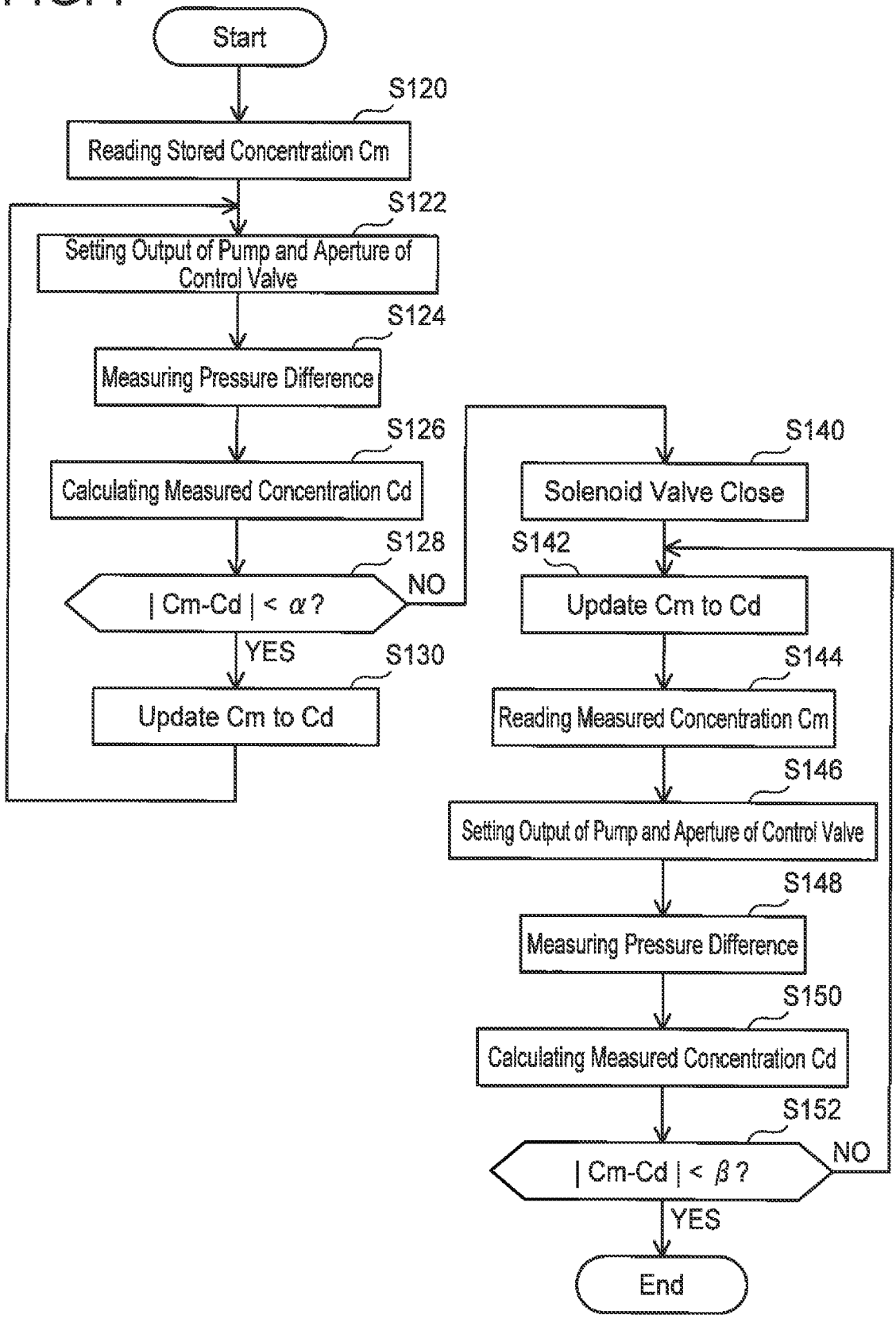
FIG. 7 shows a flowchart of a method of adjusting a purge gas supply quantity.

Next, a method of adjusting the supply quantity of the purge gas will be described with reference to FIG. 7. This method may be performed in any evaporated fuel processing device that is provided with the solenoid valve 126, the pump 52, and the branch passage 22*b*, such as the evaporated fuel processing device 20*a*. Firstly, when a purge is started (the solenoid value 126 being on), the ECU 100 reads a stored purge gas concentration (stored concentration) Cm (step S120) and performs control to adjust the output of the pump 52 and the aperture of the control valve 110 based on the stored concentration Cm (step S122). Due to this, a desired quantity of the purge gas can be introduced to the intake pipe 34. In a case where a period since a purge was stopped is long and thus the stored concentration Cm does not exist (such as a purge performed for a first time after the engine 2 has been activated), a constant value (e.g., 50%) may be used as a temporal stored concentration Cm.

During the purge, the pressure difference between the upstream and downstream sides of the control valve 110 is measured by using the differential pressure sensor 70 (step S124). A concentration (measured concentration) Cd of the purge gas passing through the purge passage 22*a* is calculated based on the measured pressure difference (step S126). After the calculation of the measured concentration Cd, the stored concentration Cm is compared with the measured concentration Cd. In a case where a difference between the stored concentration Cm and the measured concentration Cd is smaller than a predetermined value α (step S128: YES), the change in the purge gas concentration is small, so the introduction quantity of the purge gas to the intake pipe 34 can be maintained at an appropriate level simply by fine-adjusting the aperture of the control valve 110 and the like. Due to this, in the case where the difference between the stored concentration Cm and the measured concentration Cd is smaller than the predetermined value α (step S128: YES), the stored concentration Cm is updated to a value of the measured concentration Cd, the process returns to step 122, the output of the pump 52 and the aperture of the control valve 110 are adjusted based on the newly stored concentration Cm (the measured concentration Cd that was measured immediately before), and the purge is continued.

In a case where the difference between the stored concentration Cm and the measured concentration Cd is greater than the predetermined value α (step S128: NO), if the purge is continued as it is, the A/F may deviate greatly. Due to this, in the case where the difference between the stored concentration Cm and the measured concentration Cd is greater than the predetermined value α, the solenoid valve 126 is closed (step S140), and the detection of the purge gas concentration is performed in a state where the purge is stopped. After the solenoid valve 126 has been closed, the stored concentration Cm is updated to the measured concentration Cd (step S142). After this, the updated stored concentration Cm is read (step S144), the output of the pump 52 and the aperture of the control valve 110 are adjusted based on the stored concentration Cm (step S146), the pressure difference between the upstream and downstream sides of the control valve 110 is measured by using the differential pressure sensor 70 (step S148), and the concentration (measured concentration) Cd of the purge gas circulating in the purge passage 22*a* and the branch passage 22*b* is calculated (step S150).

In a case where a difference between the stored concentration Cm read in step S144 and the measured concentration Cd measured in step S150 is smaller than a predetermined value β (step S152: YES), the introduction quantity of the purge gas to the intake pipe 34 can be maintained at the appropriate level simply by fine-adjusting the conditions set in step S146. Due to this, in the case where the difference between the stored concentration Cm and the measured concentration Cd is smaller than the predetermined value β (step S152: YES), the measurement of the purge gas concentration is terminated, and the purge is continued. In a case where the difference between the stored concentration Cm and the measured concentration Cd is greater than the predetermined value β (step S152: NO), the process returns to step S142, and the adjustments of the output of the pump 52 and the aperture of the control valve 110 and the measurement of the purge gas concentration are repeated.

Figure 8:
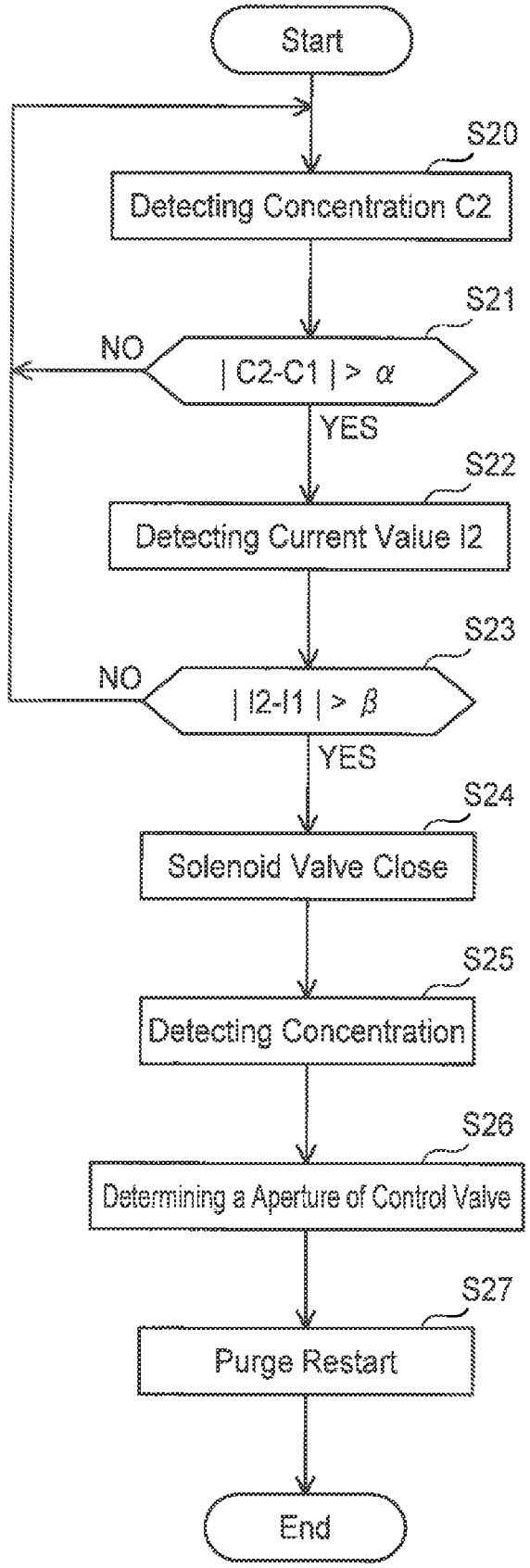
FIG. 8 shows a flowchart of a method of adjusting the purge gas supply quantity.

Next, a method of adjusting the supply quantity of the purge gas upon when the concentration of the purge gas changes during a purge will be described with reference to FIG. 8. This method may be performed in any evaporated fuel processing device that is provided with the branch passage 22*b* and capable of detecting a purge gas concentration in the state where the purge gas supply to the intake pipe 34 is stopped, such as the evaporated fuel processing device 20*a*.

The ECU 100 stores a purge gas concentration C1 based on the pressure difference detected by the differential pressure sensor 70, and adjusts a purge quantity to the intake pipe 34 by driving the pump 52 at the predetermined rotary speed and further controlling the control valve 110 based on the concentration C1. The ECU 100 also stores a current value I1 that is supplied upon driving the pump 52 at the predetermined rotary speed. Hereinbelow, the concentration C1 may be termed a stored concentration C1, and the current value I1 may be termed a stored current value I1. A currently measured concentration C2 is detected in step S20, and the stored concentration C1 is compared with the measured concentration C2 in step S21. In a case where a difference between the stored concentration C1 and the measured concentration C2 is smaller than a predetermined value α (step S21: NO), it is determined that a change in the purge gas concentration is within an allowable range, and the purge to the intake pipe 34 is continued based on the stored concentration C1. In a case where the difference between the stored concentration C1 and the measured concentration C2 is greater than the predetermined value α (step S21: YES), the process proceeds to step S22 and a measured current value I2 that is currently being supplied to the pump 52 is measured. After this, the measured current value I2 supplied to the pump 52 is compared with the stored current value I1 (step S23). In a case where a difference between the measured current value I2 and the current value I1 is smaller than a predetermined value β (step S23: NO), it is determined that the change in the purge gas concentration is within the allowable range, and the purge to the intake pipe 34 is continued based on the stored concentration C1.

In a case where the difference between the current value I2 and the stored current value I1 is greater than the predetermined value β (step S23: YES), the ECU 100 closes the solenoid valve 126 and stops the supply of the purge gas to the intake pipe 34 (step S24). After this, the purge gas concentration is measured with the solenoid valve 126 closed (step S25), and the aperture (area of the opening) of the control valve 110 is determined according to the purge gas concentration obtained in step S25 (step S26). After this, the purge is restarted (step S27). For the measurement of the purge gas in step S25, the aforementioned measurement method may be, used.

In the above method, in a case where changes in both the measured concentration C2 and the measured current value I2 are large, the purge gas concentration is detected again due to the change in the purge gas concentration being beyond the allowable range. As aforementioned, the flow rate of the pump 52 is dependent on the purge gas concentration. That is, when the purge gas concentration increases, the viscosity of the gas increases, and the current value for driving the pump 52 at the predetermined rotary number increases. The change in the current value of the pump 52, exceeding the predetermined value β means that the change in the purge gas concentration is large. In this case, if the purge is continued as it is, the A/F deviates greatly from a control value. By measuring the purge gas concentration again with the solenoid valve 126 closed, the A/F can be suppressed from being deviated.

Figure 9:
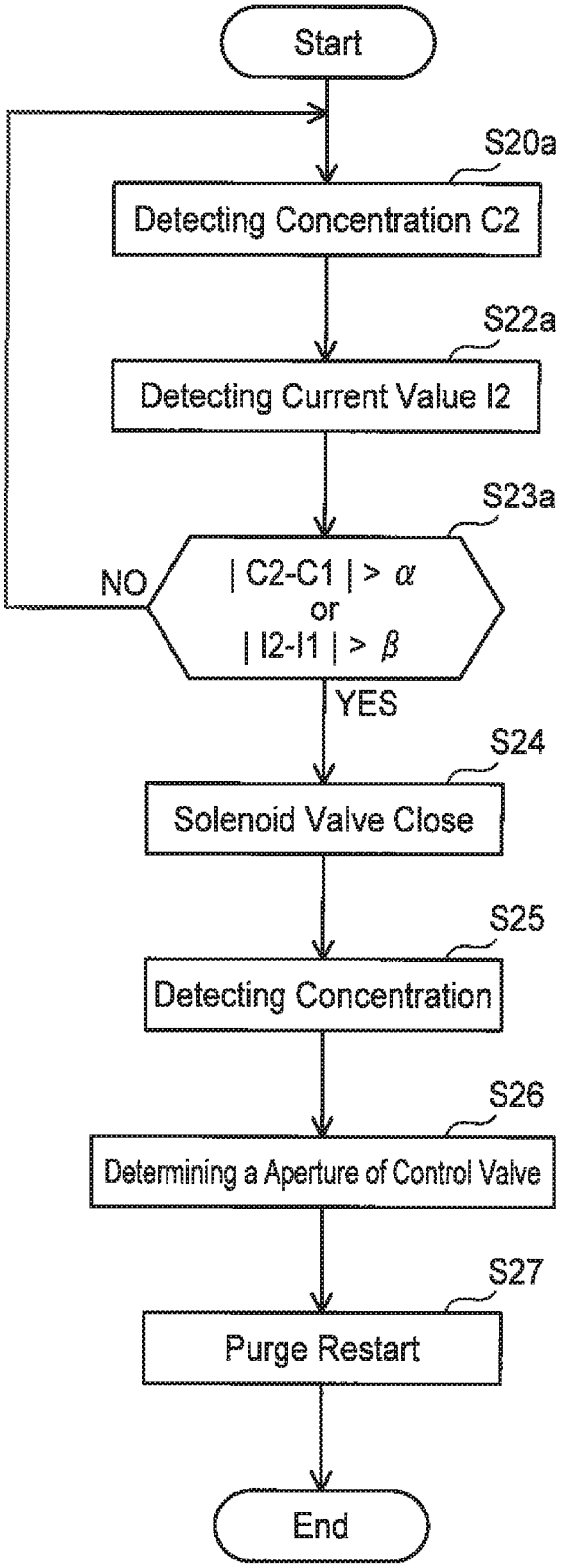
FIG. 9 shows a flowchart of a method of adjusting the purge gas supply quantity.
Figure 10:
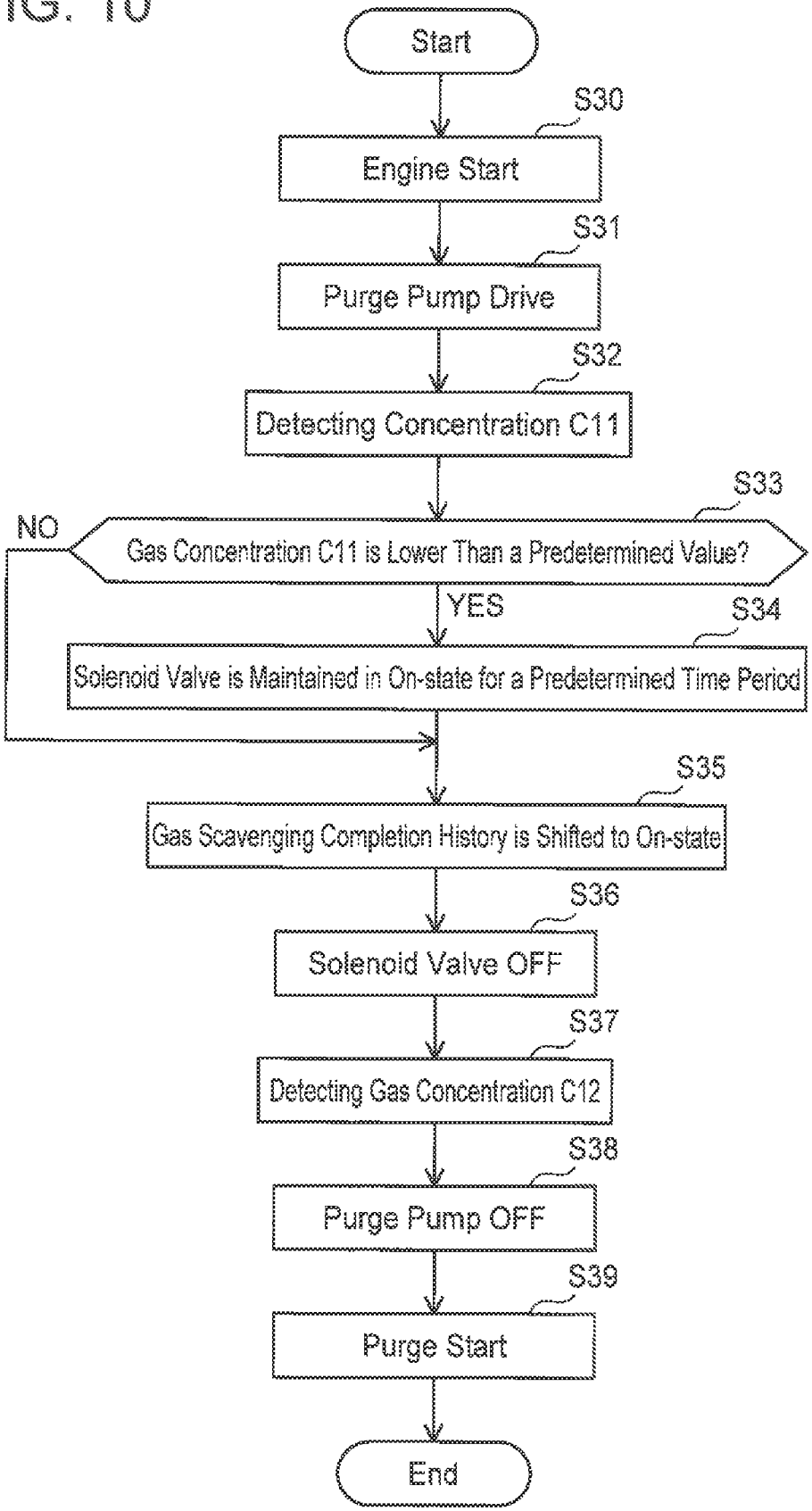
FIG. 10 shows a flowchart of a method of adjusting the purge gas supply quantity.

As shown in FIG. 9, in a case where the change in one of the measured concentrations C2 and the measured current value I2 is large, the purge gas concentration may be measured again due to the change in the purge gas concentration being beyond the allowable range. In this case, the measured concentration C2 is detected in step S20*a*, and the measured current value I2 is detected in step S22*a*. After this, the stored concentration C1 is compared with the measured concentration C2 and the measured current value I2 is compared with the stored current value I1 (step S23*a*). In the case where the difference between the stored concentration C1 and the measured concentration C2 is greater than the predetermined value α or in the case where the difference between the current value I2 and the stored current value I1 is greater than the predetermined value β, the solenoid valve 126 is closed (step S24*a*), the concentration of the purge gas is measured (step S25*a*), the aperture of the control valve 110 is determined (step S26*a*), and the purge is restarted (step S27*a*). In this case, when the concentration of the purge gas changes, the change can more surely be detected.

A method of adjusting the supply quantity of the purge gas upon when the concentration of the purge gas changes during a purge will be described with reference to FIGS. 10 to 13. This method may be performed in the evaporated fuel processing device 20*a*. That is, it can be performed in an evaporated fuel processing device that is provided with the branch passage 22*b* and detects a purge gas concentration in the state where the supply of the purge gas to the intake pipe 34 is stopped. In this method, before a purge is performed to the intake pipe 34, gas remaining in the purge passage (the purge gas that remained upon when the previous purge was completed) is scavenged (that is, discharged to the intake pipe 34). When the gas remaining in the purge passage is scavenged, the evaporated fuel adsorbed in the canister 19 is introduced into the purge passage. FIGS. 12 and 13 are timing charts showing timings to perform a purge and on/off states of the pump 52 and the solenoid valve 126. The on/off states of the pump 52 and the solenoid valve 126 are controlled by control signals from the ECU 100.

A timing t0 indicates a timing when the vehicle entered a state in which it is capable of traveling. For example, a time when the engine 2 is activated corresponds to the timing to. At the timing t0, gas is stagnating in the purge passage, and the ECU 100 stores that the gas in the purge passage has not been scavenged. At the timing t0, the ECU 100 stores that a gas scavenging completion history is in an OFF state. At the timing t0, the pump 52 and the solenoid valve 126 are off After the engine 2 is activated (step S30), the pump 52 is driven while the solenoid valve 126 is closed (in the off-state) (step S31: timing t1). The concentration of the purge gas is measured during a time from the timing t1 to a timing t2 while the solenoid valve 126 is maintained in the off-state (step S32). The aforementioned methods may be used as a method of measuring the concentration of the purge gas.

In a case where a purge gas concentration C11 detected in step S32 is lower than a predetermined value (step S33: YES), the process proceeds to step S34 and the solenoid valve 126 is turned on and maintained in the on-state for a predetermined time period while the pump 52 is maintained in the on-state (timings t2 to t3). Due to this, the gas that was stagnating in the purge passage (the purge gas that remained from when the previous purge was terminated) can be scavenged from the purge passage. The time period during which the solenoid valve 126 is maintained in the on-state (timings t2 to t3) is determined based on the purge gas concentration C11 detected during the time from the timing t1 to the timing t2. Due to this, the A/F can be suppressed from being deviated greatly by the purge gas scavenged to the intake pipe 34.

When the scavenging of the remaining gas is completed, the gas scavenging completion history is shifted to an ON state (step S35, timing t3). The gas scavenging completion history is maintained in the ON state during when the engine 2 is driving. Further, after the scavenging of the remaining gas is completed, the solenoid valve 126 is turned off while the pump 52 is maintained to be driven (step S36, timing t3). After this, a purge gas concentration C12 in the purge passage is detected (step S37). After the detection of the purge gas concentration C12, the pump 52 is turned off (step S38, timing t4). A value of the purge gas concentration C12 detected between the timings t3 and t4 is used when the ECU 100 outputs a purge-ON signal (when a purge is actually started: step S39, timing t5). That is, upon when a purge is started, the aperture of the control valve 110, the output of the pump 52, and the like are determined based on the value of the gas concentration C12.

In a case where the concentration C11 of the purge gas in the purge passage is higher than the predetermined value in step S33 (step S33: NO), the solenoid valve 126 is not turned on at the timing t2 as shown in FIG. 13. Further, although the scavenging in the purge passage is actually not finished yet, the process proceeds to step S35 and the gas scavenging completion history is set to the ON state. In this case, upon when a purge is actually started (timing t5), the aperture of the control valve 110, the output of the pump 52, and the like are determined based on the value of the gas concentration C11. In a case where the gas concentration in the purge passage (concentration of the remaining gas) is high, the A/F tends to become rich when this gas is scavenged to the intake pipe 34. When this occurs, nitrogen oxides tend to be generated in exhaust gas. Due to this, in the case where the concentration of the remaining gas in the purge passage is higher than the predetermined value, the scavenging of the purge passage is not performed, and the aperture of the control valve 110 and the output of the pump 52 are determined based on the gas concentration C11.

Figure 11:
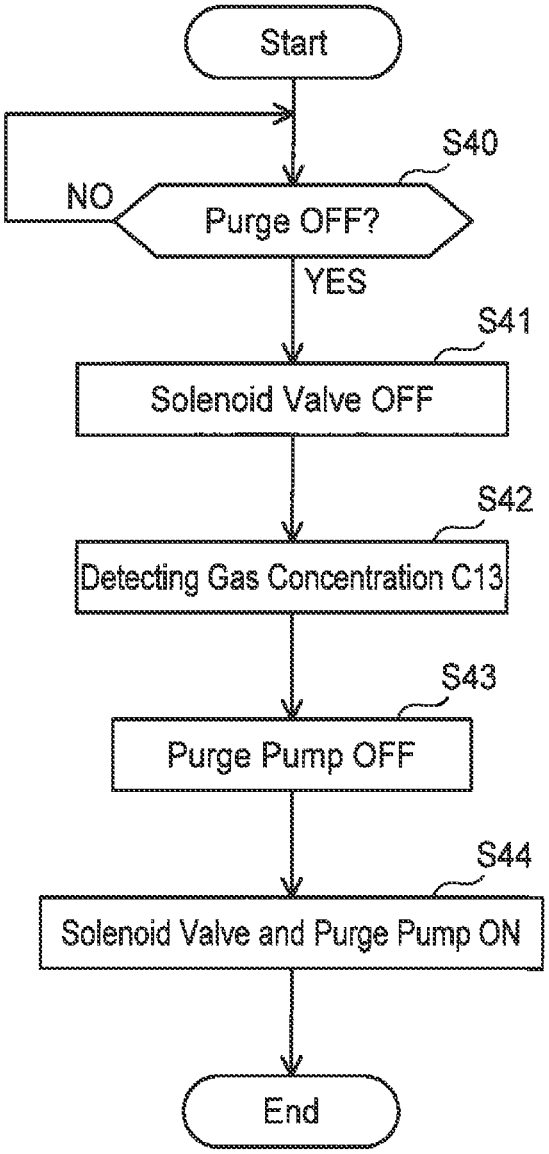
FIG. 11 shows a flowchart of a method of adjusting the purge gas supply quantity.
Figure 12:
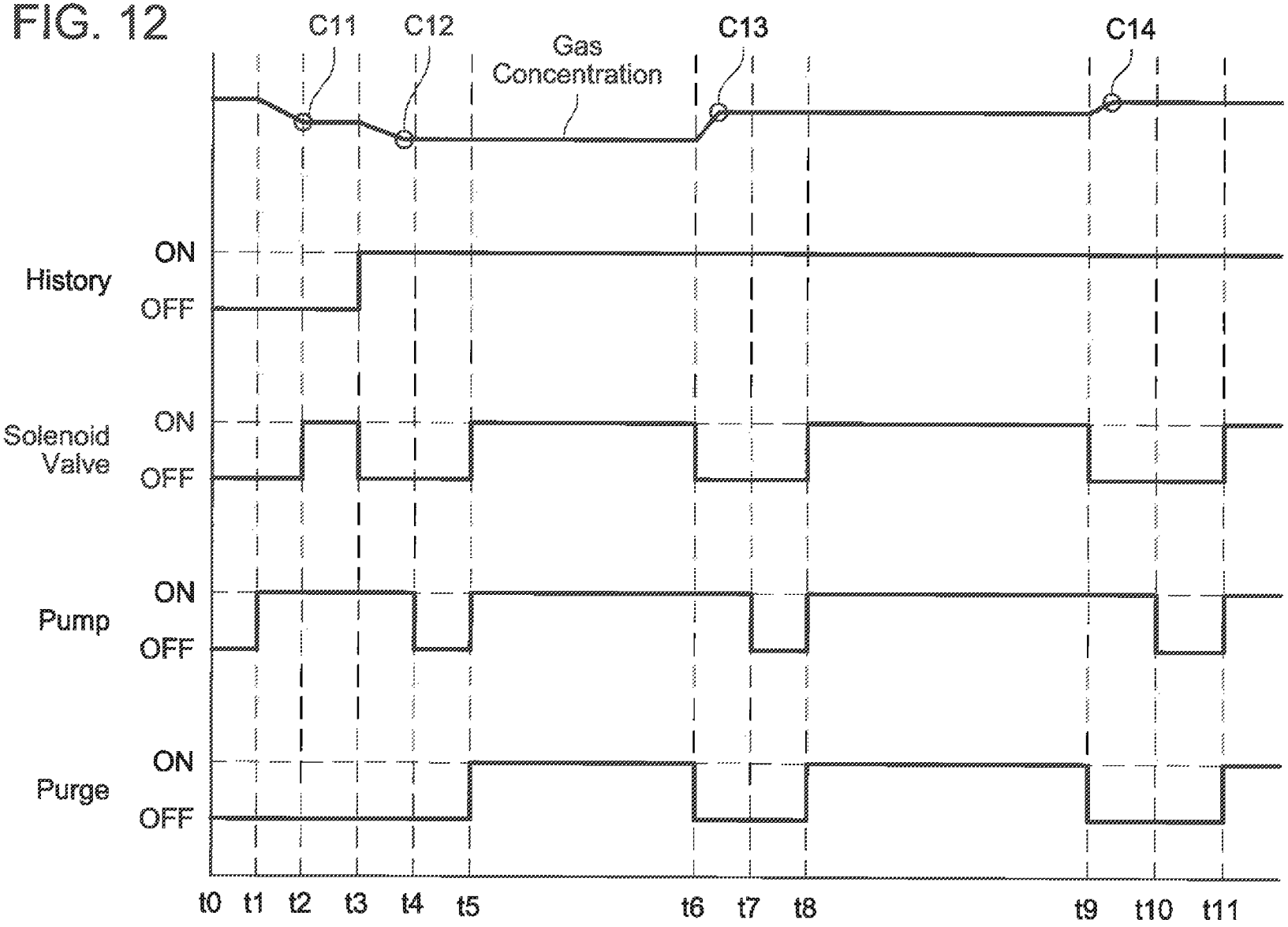
FIG. 12 shows a timing chart of a process of adjusting the purge gas supply quantity.
Figure 13:
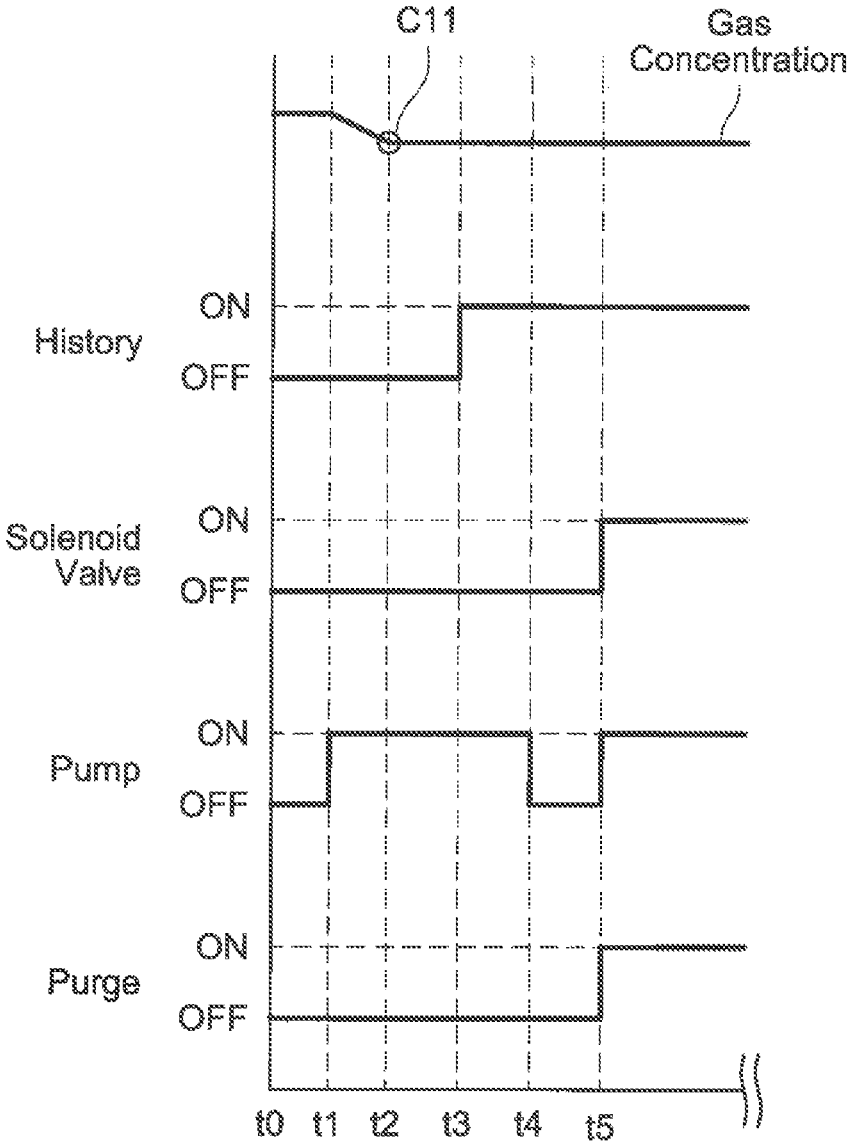
FIG. 13 shows a timing chart of a process of adjusting the purge gas supply quantity.

FIG. 11 shows the method of adjusting the purge gas supply quantity from the timing t5 and thereafter in FIG. 12. When a purge is started at the timing t5, the pump 52 is driven, the solenoid valve 126 is on, and the purge gas is supplied to the intake pipe 34 during a time period from the timing t5 to a timing t6. In step S40, a determination is made on whether or not a purge-OFF signal is outputted at the timing t5 or thereafter. In a case where the purge-OFF signal is outputted (step S40: YES), the solenoid valve 126 is turned off (step S41, timing t6). At the timing t6, the pump 52 is maintained to be driven (timings t6 to t7). A gas concentration C13 in the purge passage is detected during a time period from the timing t6 to a timing t7 (step S42). After the detection of the gas concentration C13, the pump 52 is turned off (step S43, timing t7). After this, when the purge-ON signal is outputted (timing t8), the solenoid valve 126 is turned on and the pump 52 is turned on (step S44).

During a time period from the timing t8 to a timing t9, the aperture of the control valve 110 and the output of the pump 52 are determined based on the gas concentration C13. In timings t9 to t11, the same operations as those in the timings t6 to t8 are performed. That is, the pump 52 is driven for the predetermined time period (t9 to t10) while the purge is in the OFF state (t9 to t11), and a gas concentration C14 is detected.

In the above method, the concentration of the purge gas is detected while the purge is in the OFF state (the solenoid valve 126 is closed), and the aperture of the control valve 110 and the output of the pump 52 during the purge being the ON state (the solenoid valve 126 being opened) are controlled based on the detected gas concentration. Since the concentration of the purge gas is known upon when the purge is started, the purge gas supply quantity can be adjusted more accurately. Further, since the purge passage is scavenged during the time period between the activation of the engine 2 and the start of the purge, the concentration of the purge gas supplied from the canister 19 can effectively be reflected in the purge supply quantity when the purge is started. Further, upon when the purge passage is scavenged, the concentration of the purge gas remaining in the purge passage is detected before the scavenge, so the A/F can be prevented from being deviated greatly upon the scavenging.

Figure 17:
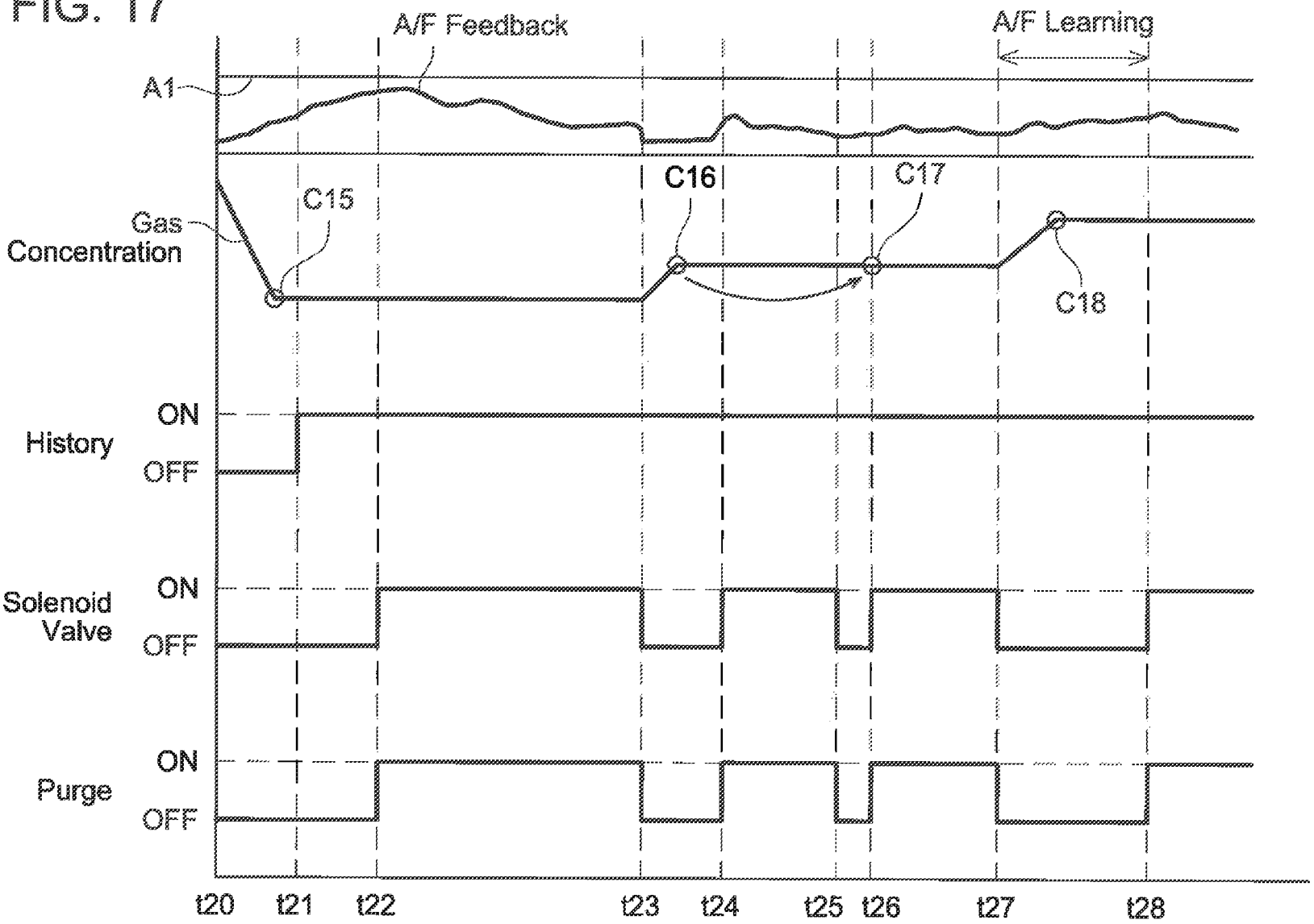
FIG. 17 shows a timing chart of a process of adjusting the purge gas supply quantity.
Figure 18:
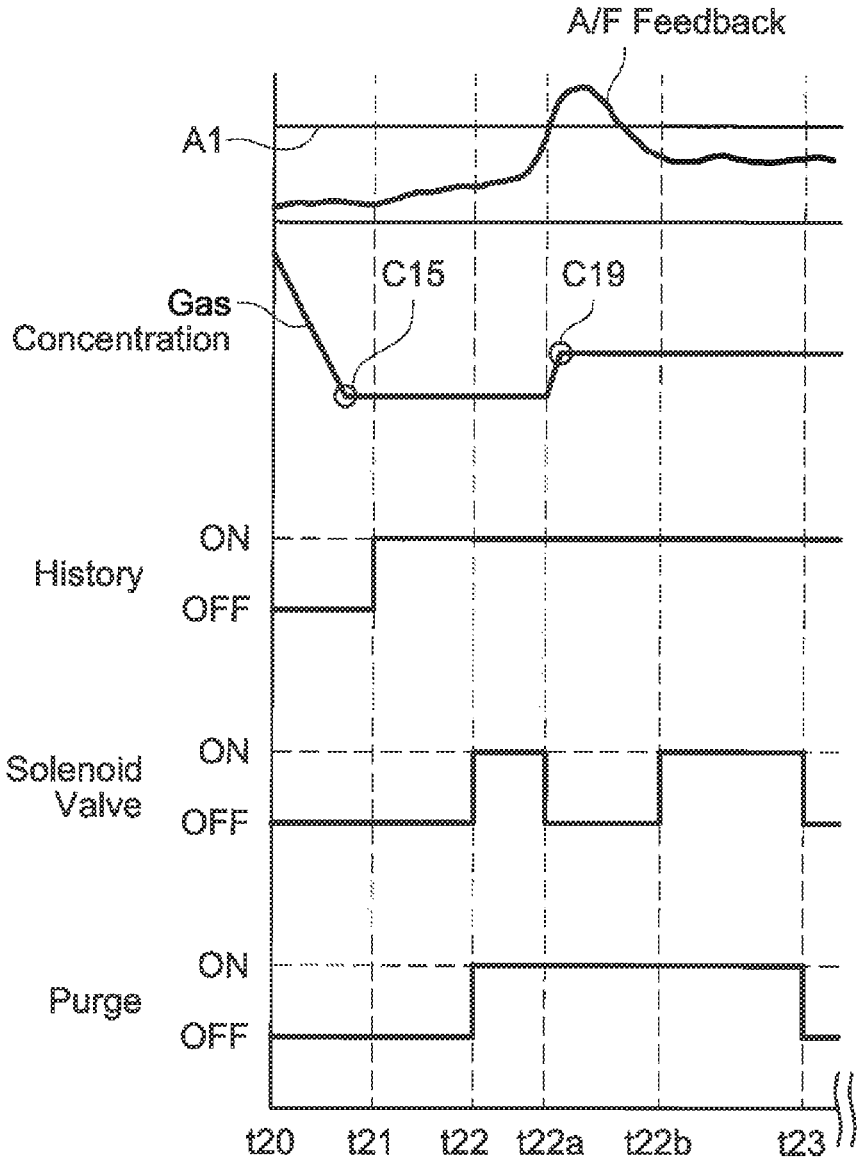
FIG. 18 shows a timing chart of a process of adjusting the purge gas supply quantity.

Another method of adjusting the supply quantity of the purge gas upon when the concentration of the purge gas changes during a purge will be described with reference to FIGS. 14 to 18. This method can be performed in an evaporated fuel processing device that is provided with the branch passage 22*b* and is capable of detecting a purge gas concentration in the state where the purge gas supply to the intake pipe 34 is stopped (such as the evaporated fuel processing device 20*a*). In this method, the purge gas is supplied to the intake pipe 34 while the concentration of the purge gas is corrected based on a temperature change in the engine 2. FIGS. 17 and 18 are timing charts indicating timings to perform a purge and the on/off states of the solenoid valve 126. The on/off states of the solenoid valve 126 are controlled by a control signal from the ECU 100.

Typically, after the engine has been activated, a temperature of the engine rises. When the temperature of the engine rises, a temperature in the purge passage also rises and the concentration of the purge gas in the purge passage thereby changes. The concentration of the purge gas can be detected accurately by detecting the concentration of the purge gas based on the temperature change of the engine, and the A/F can be suppressed from being greatly deviated. As the engine is driven, an engine water temperature (temperature of cooling water in the engine) rises. In this method, the method of detecting the purge gas concentration is changed depending on whether or not the engine water temperature exceeds a predetermined value.

Figure 14:
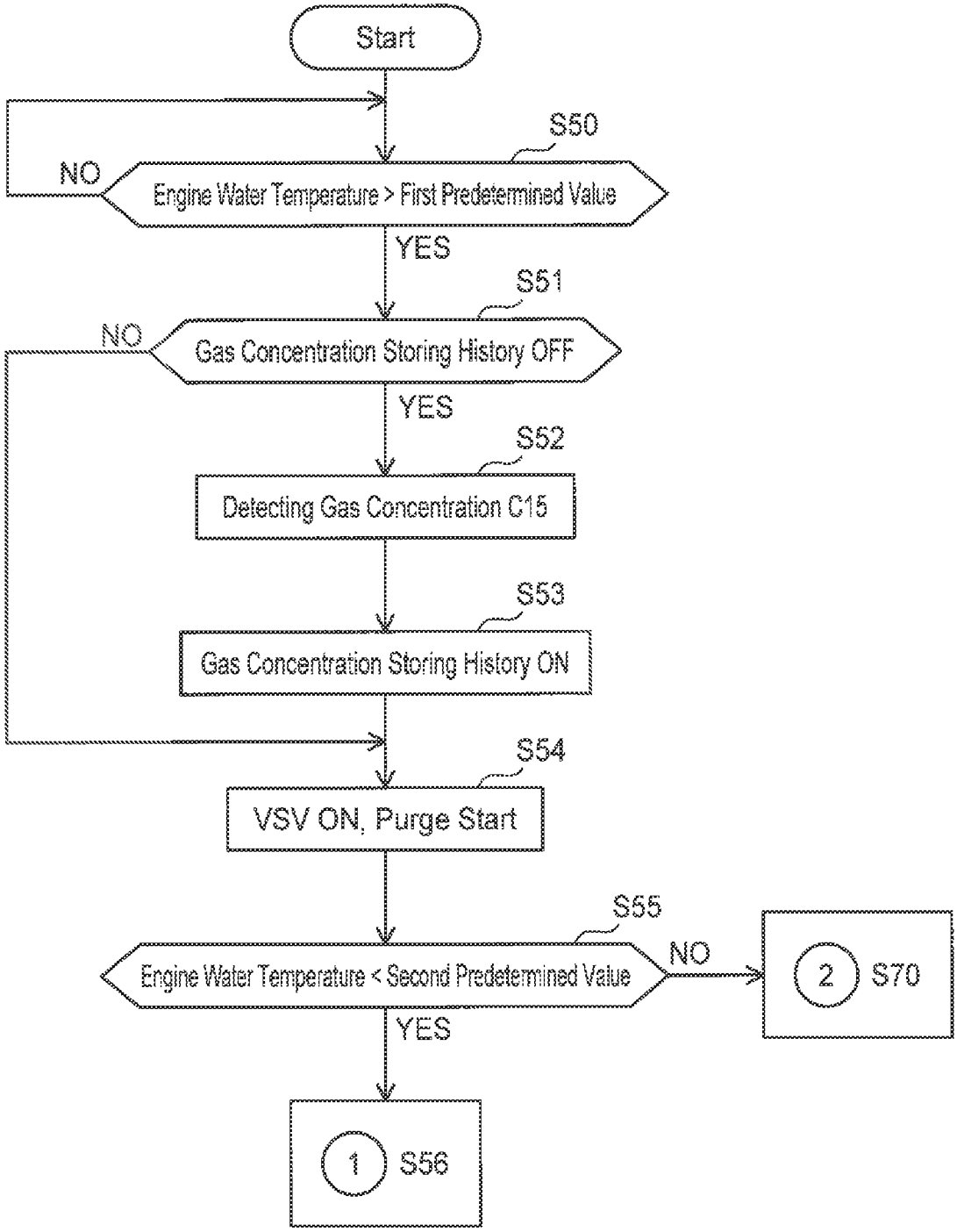
FIG. 14 shows a flowchart of a method of adjusting the purge gas supply quantity.

In step S50 of FIG. 14, it is determined whether or not the engine water temperature exceeded a first predetermined value (e.g., 15° C.). In a case where the engine water temperature does not exceed the first predetermined value (step S50: NO), the engine water temperature is repeatedly measured until the engine water temperature exceeds the first predetermined value. When the engine water temperature has exceeded the first predetermined value (step S50: YES), in a case where a gas concentration history for the purge gas is not stored in the ECU 100 (step S51: YES), the concentration of the purge gas is started to be measured with the solenoid valve 126 closed (step S52, timings t20 to t21). The measurement of the concentration of the purge gas with the solenoid valve 126 closed can be performed by the aforementioned method. A gas concentration C15 upon when the concentration of the purge gas stabilized is stored in the ECU 100 as the gas concentration history, and a gas concentration storing history is set to an ON state (step S53, timing t21).

After the gas concentration storing history has been set to the ON state, the solenoid valve 126 is turned on and a purge is started (step S54, timing t22). Upon when the purge is started, the aperture of the control valve 110 and the flow rate (output) of the pump 52 are determined based on the gas concentration C15. In a case where the gas concentration of the purge gas is stored in the ECU 100 (step S51: NO), the purge is started based on the stored gas concentration. That is, in the case where the gas concentration is not stored (the gas concentration storing history is OFF), the gas concentration is measured without starting a purge (the first purge after the engine has been activated), and then the purge is started. During the purge, whether the engine water temperature is less than a second predetermined value (e.g., 60° C.) (step S55: YES) or the engine water temperature is equal to or greater than the second predetermined value (step S55: NO) is measured. In this method, a method of correcting the purge gas concentration differs depending on whether the engine water temperature is less than the second predetermined value or not. In the case where the engine water temperature is less than the second predetermined value, the process proceeds to a process of step S56 in FIG. 15. In a case where the purge is set to the ON state (the solenoid valve 126 is in the on-state) in step S56 (step S56: YES), and in a case where a feedback deviation from an A/F sensor is equal to or less than a predetermined value A1 (step S57: NO), the purge is continued (step S58). A case where the feedback deviation from the A/F sensor is greater than the predetermined value A1 (step S57: YES) will be described later. The feedback deviation from the A/F sensor may be used to correct the purge gas concentration stored in the ECU 100 based on the feedback deviation without stopping the purge (while continuing the purge). By correcting the gas concentration, the supply quantity of the purge gas can more accurately be adjusted.

In a case where the purge is set to the off-state in step S56 (timing t23, step S56: NO), the process proceeds to step S59 and it is determined whether or not a purge-off period (a period between timings t23 and t24) is longer than a predetermined time period T1. In a case where the period between t23 and t24 is longer than the predetermined time period T1 (step S59: YES), the concentration of the purge gas is measured with the purge in the off-state (step S60). A gas concentration C16 upon when the concentration of the purge gas stabilized is stored in the ECU 100 (step S61), the process returns to step S54 of FIG. 14 at the timing t24 when the next purge is started, the aperture of the control valve 110 and the flow rate of the pump 52 are controlled based on the concentration C16, and the purge is continued.

In a case where the purge-off period is shorter than the predetermined time period T1 in step S59, such as a period between t25 and t26 (step S59: NO), the concentration of the purge gas cannot be detected while the purge is in the off state. In this case, the gas concentration C16 stored in the ECU 100 when the purge was set to the off-state (at the timing t25) (gas concentration that was measured when the purge was previously set to the off-state) is stored as a gas concentration C17 to be used at a timing of the next purge (at the timing t26) (step S62). After this, the process returns to step S54 of FIG. 14, the aperture of the control valve 110 and the flow rate of the pump 52 are controlled based on the gas concentration C17 (the gas concentration C16), and the purge is continued.

Figure 15:
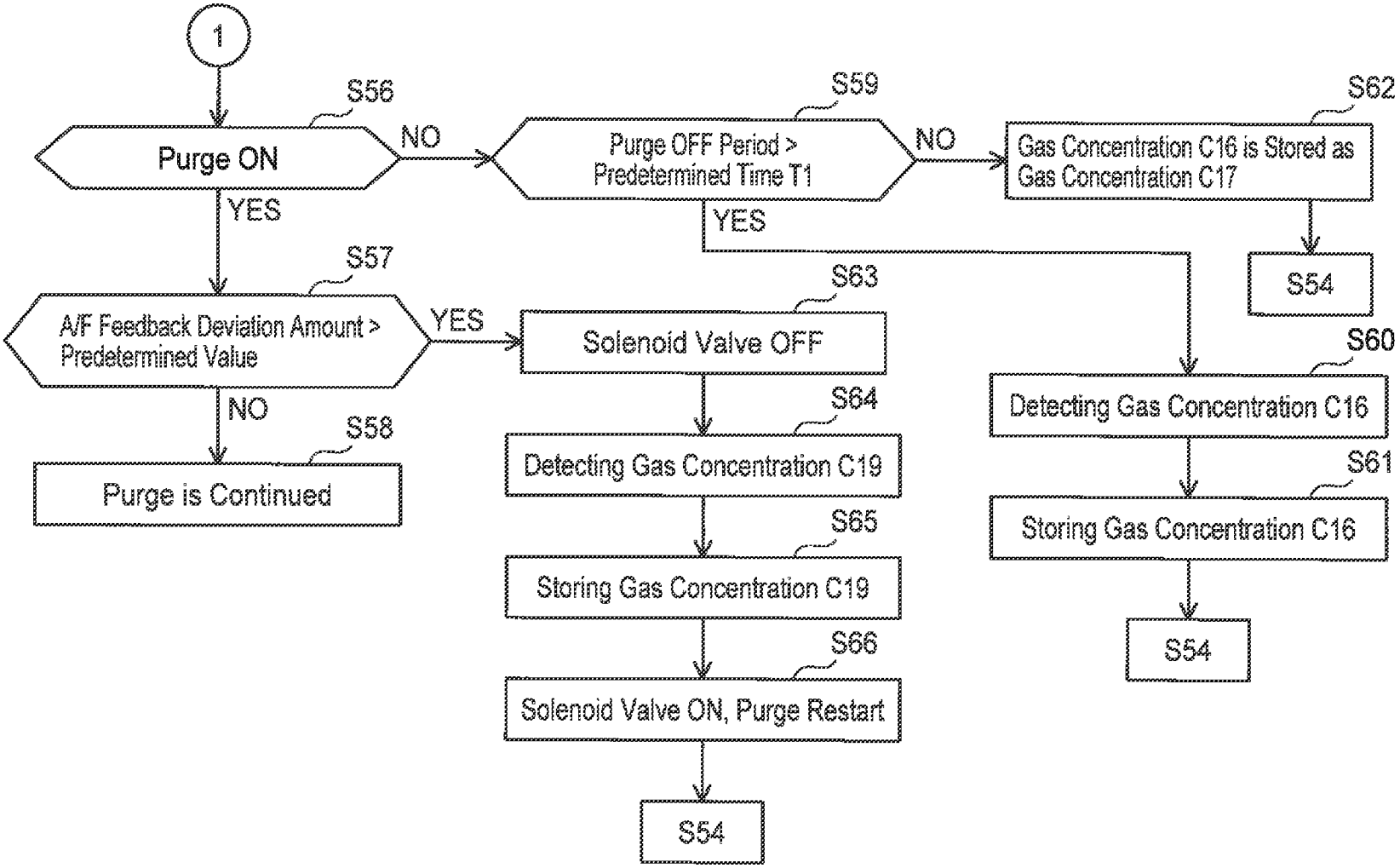
FIG. 15 shows a flowchart of a method of adjusting the purge gas supply quantity.
Figure 16:
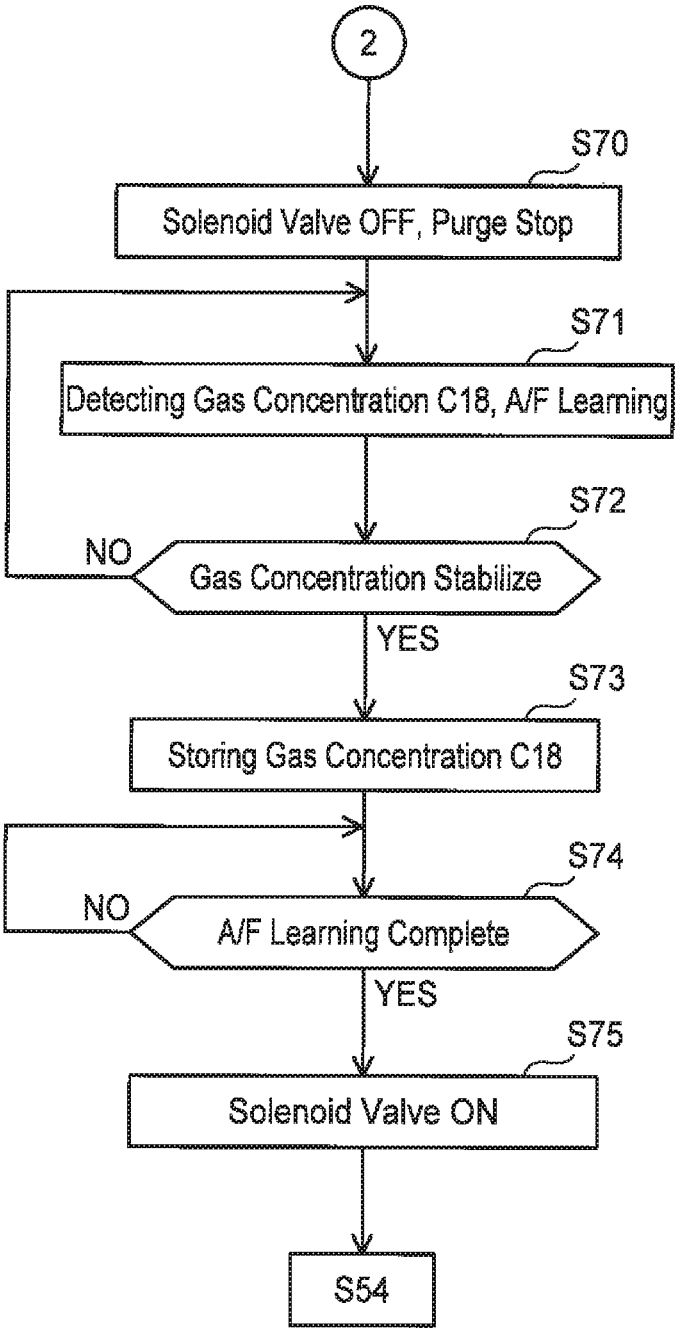
FIG. 16 shows a flowchart of a method of adjusting the purge gas supply quantity.

Here, the case where the feedback deviation from the A/F sensor is greater than the predetermined value A1 in step S57 of FIG. 15 (step S57: YES) will be described with reference to FIG. 18. In this case, even when the purge is in the on-state (timings t22 to t23), the solenoid valve 126 is turned off for a predetermined time period (step S63, timing t22*a*) and a purge gas concentration C19 is measured (step S64). That is, the purge is substantially set to the off-state. The purge gas concentration C19 upon when the concentration of the purge gas stabilized is stored in the ECU 100 (step S65), and then the purge is restarted (the solenoid valve 126 is turned on) (step S66, timing t22*b*). The process returns to step S54 of FIG. 14 at the timing t22*b*, the aperture of the solenoid valve 126 and the flow rate of the pump 52 are controlled based on the gas concentration C19, and the purge is continued.

Next, a case where the engine water temperature in FIG. 14 is equal to or greater than the second predetermined value (step S55: NO) will be described with reference to FIGS. 16 and 17. Typically, in the vehicle, an A/F learning is started when the engine water temperature becomes equal to or greater than the second predetermined value (e.g., 60° C.). When the engine water temperature becomes equal to or greater than the second predetermined value (step S55: NO), the solenoid valve 126 is turned off and the purge is stopped (step S70, timing t27). The measurement of the purge gas concentration and the A/F learning are started under the state in which the purge is stopped (step S71). In a case where the purge gas concentration is not stabilized (step S72: NO), the detection is continued until the purge gas concentration stabilizes. After the purge gas concentration has stabilized (step S72: YES), a detected gas concentration C18 is stored in the ECU 100 (step S73). After this, it is determined whether or not the A/F learning is completed (step S74). In a case where the A/F learning is completed (step S74: YES), the solenoid valve 126 is turned on (step S75, timing t28), the aperture of the control valve 110 and the flow rate of the pump 52 are controlled based on a concentration that is obtained by correcting the gas concentration C18 by an A/F feedback, and the purge is continued.

While specific examples of the present invention have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present invention is not limited to the combinations described at the time the claims are filed. Further, the purpose of the examples illustrated by the present description or drawings is to satisfy multiple objectives simultaneously, and satisfying any one of those objectives gives technical utility to the present invention.

The invention claimed is:

1. An evaporated fuel processing device comprising: a canister configured to adsorb fuel evaporated in a fuel tank; a purge passage that is connected between the canister and an intake passage of an engine, and through which a purge gas sent from the canister to the intake passage passes; a control valve provided on the purge passage, an aperture of the control valve being variable, and the control valve configured to control an introduction amount of the purge gas to the intake passage by changing the aperture; a pump provided on the purge passage between the control valve and the canister, the pump is configured to discharge the purge gas from the canister to the intake passage; and a concentration sensor configured to detect a purge gas concentration of the purge gas passing through the purge passage based on a pressure difference between an upstream side and a downstream side of the control valve and a solenoid valve provided on the purge passage on an intake passage side relative to the control valve, and configured to switch between a communication state and a cutoff state, the communication state being a state in which the canister and the intake passage communicate with each other via the purge passage, and the cutoff state being a state in which communication between the canister and the intake passage is cut off on the purge passage; and a branch passage including one end connected to the purge passage between the control valve and the solenoid valve, and another end connected to the purge passage on a canister side relative to the pump, wherein the evaporated fuel processing device is configured to circulate the purge gas through the control valve in a case where the pump is driven with the solenoid valve being in the cutoff state.

2. The evaporated fuel processing device according to claim 1, further comprising: a controller configured to control an operation of the solenoid valve; wherein the controller is configured to switch the solenoid valve to the cutoff state in a case where a change in a concentration of the purge gas exceeds a predetermined value when the purge gas is introduced to the intake passage.

3. The evaporated fuel processing device according to claim 2, wherein the controller is configured to switch the solenoid valve to the cutoff state and adjust the aperture of the control valve according to the concentration of the purge gas after the change, and thereafter switch the solenoid valve to the communication state.

4. The evaporated fuel processing device according to claim 1, further comprising: a controller configured to control an operation of the solenoid valve; wherein the controller is configured to switch the solenoid valve to the cutoff state in a case where a change in an output of the pump exceeds a predetermined value when the purge gas is introduced to the intake passage.

5. The evaporated fuel processing device according to claim 2, wherein the controller is configured to perform control to detect the concentration of the purge gas again after having switched the solenoid valve to the cutoff state.

6. The evaporated fuel processing device according to claim 3, wherein the controller is configured to perform control to detect the concentration of the purge gas again after having switched the solenoid valve to the cutoff state.

7. The evaporated fuel processing device according to claim 4, wherein the controller is configured to perform control to detect the concentration of the purge gas again after having switched the solenoid valve to the cutoff state.

* * * * *